US010605548B1

(12) United States Patent
Lukofnak, III

(10) Patent No.: US 10,605,548 B1
(45) Date of Patent: Mar. 31, 2020

(54) ROTATABLE FIREARM TAKE-DOWN PIN

(71) Applicant: Richard Framz Lukofnak, III, Winchester, CA (US)

(72) Inventor: Richard Franz Lukofnak, III, Winchester, CA (US)

( * ) Notice: Subject to any disclaimer, the term of this patent is extended or adjusted under 35 U.S.C. 154(b) by 0 days.

(21) Appl. No.: 15/902,527

(22) Filed: Feb. 22, 2018

(51) Int. Cl.
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
None
See application file for complete search history.

(56) References Cited

U.S. PATENT DOCUMENTS

2014/0317982 A1* 10/2014 Gentilini ..... F41A 3/12 42/16
2015/0308768 A1* 10/2015 Mills ..... F41A 11/04 42/75.03
2015/0323269 A1* 11/2015 McGinty ..... F41A 11/00 42/16
2019/0072123 A1* 3/2019 Adams ..... F16B 19/02

FOREIGN PATENT DOCUMENTS

FR 1548726 * 10/1968

* cited by examiner

*Primary Examiner* — Stephen Johnson
(74) *Attorney, Agent, or Firm* — Quickpatents, LLC; Kevin Prince

(57) ABSTRACT

A replacement takedown pin for a firearm of the type having an upper receiver, a lower receiver, and a rear takedown pin mechanism comprises an elongated cylindrical body having a pin capture mechanism at a distal end thereof, a knob at a proximal end thereof, and a clearance notch at a central portion thereof. When the knob is in an engaged rotational position, the notch of the cylindrical body is misaligned with the catch of the takedown pin mechanism, preventing the upper receiver from being removed from the lower receiver. When the knob is rotated to a disengaged rotational position, the notch of the cylindrical body becomes aligned with the catch of the takedown pin mechanism of the firearm, thereby allowing the catch to pass the takedown pin and allowing the upper receiver to be separated from the lower receiver.

6 Claims, 3 Drawing Sheets

ROTATABLE FIREARM TAKE-DOWN PIN

STATEMENT REGARDING FEDERALLY SPONSORED RESEARCH AND DEVELOPMENT

Not Applicable.

FIELD OF THE INVENTION

This invention relates to firearms, and more particularly to an improved take-down pin for separating firearm upper receivers from lower receivers.

BACKGROUND AND DISCUSSION OF RELATED ART

Certain onerous jurisdictions have laws that prohibit a magazine in a firearm from being removed for reloading without requiring the firearm to be at least partially disassembled. With firearms having both upper and lower receivers, such disassembly can take the form of separating the upper receiver from the lower receiver. This is most easily accomplished by removing a rear takedown pin that allows the upper receiver to be rotated away from the lower receiver about a front pivot pin. However, removing the rear takedown pin from such a firearm sustains the risk of inadvertently dropping the takedown pin or otherwise misplacing it after reloading a fresh magazine, and of trying to re-engage the takedown pin after reloading perhaps while taking fire, and as a result such an operation is fraught with increased risk. Such risk is particularly high in life-or-death shoot-out situation where criminal elements are not burdened with the moral obligation to follow local laws requiring their guns to be disassembled in order to be reloaded.

Therefore, there is a need for a device that allows for the quick disassembly of a firearm without requiring the full removal of the takedown pin. Such a needed invention would provide for single finger actuation and be relatively quick to install and intuitive to use. The present invention accomplishes these objectives.

SUMMARY OF THE INVENTION

The present device is a takedown pin for a firearm of the type having an upper receiver and a lower receiver fixed together with a front pivot pin and a rear takedown pin and pin mechanism that includes a catch or hook, or a pin aperture.

The takedown pin comprises an elongated cylindrical body having at a distal end a pin capture mechanism, as is known in the art. The takedown pin further has at a knob at a proximal end of the cylindrical body, and a clearance notch at a central portion of the cylindrical body. The cylindrical body is adapted for rotational movement within the takedown pin mechanism and traverses both the lower receiver and the upper receiver's takedown pin mechanism. The knob preferably includes a laterally-projecting lever for indicating the orientation of the notch from within the firearm. The notch is preferably about half of the volume of the cylindrical body at the central portion thereof to allow clearance of the catch of the takedown pin mechanism.

In use, with the knob in an engaged rotational position, the notch of the cylindrical body is misaligned with the catch of the takedown pin mechanism of the firearm, preventing the upper receiver from being removed from the lower receiver. The notch of the cylindrical body becomes aligned with the catch of the takedown pin mechanism of the firearm when the knob is rotated to a disengaged rotational position, thereby allowing the catch to pass the takedown pin, allowing the upper receiver to be separated from the lower receiver, pivoting around the front pivot pin.

In firearms that have a takedown pin aperture, the structure of the upper receiver may first be modified to form the catch or hook that will allow clearance of the takedown pin past the catch when the takedown pin is in the disengaged rotational position. That is to say that such a takedown pin aperture, through which the takedown pin would otherwise traverse, can be modified by cutting it substantially in half, such that the aperture now forms the catch or hook. The catch does not engage the takedown pin when the takedown pin is in the disengaged rotational position, but it does catch and engage the central portion of the cylindrical body adjacent the notch when the takedown pin is in the engaged rotational position.

The present invention is a device that allows for the quick disassembly of a firearm without requiring the full removal of the takedown pin. The present invention provides for single finger actuation and is relatively quick to install and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
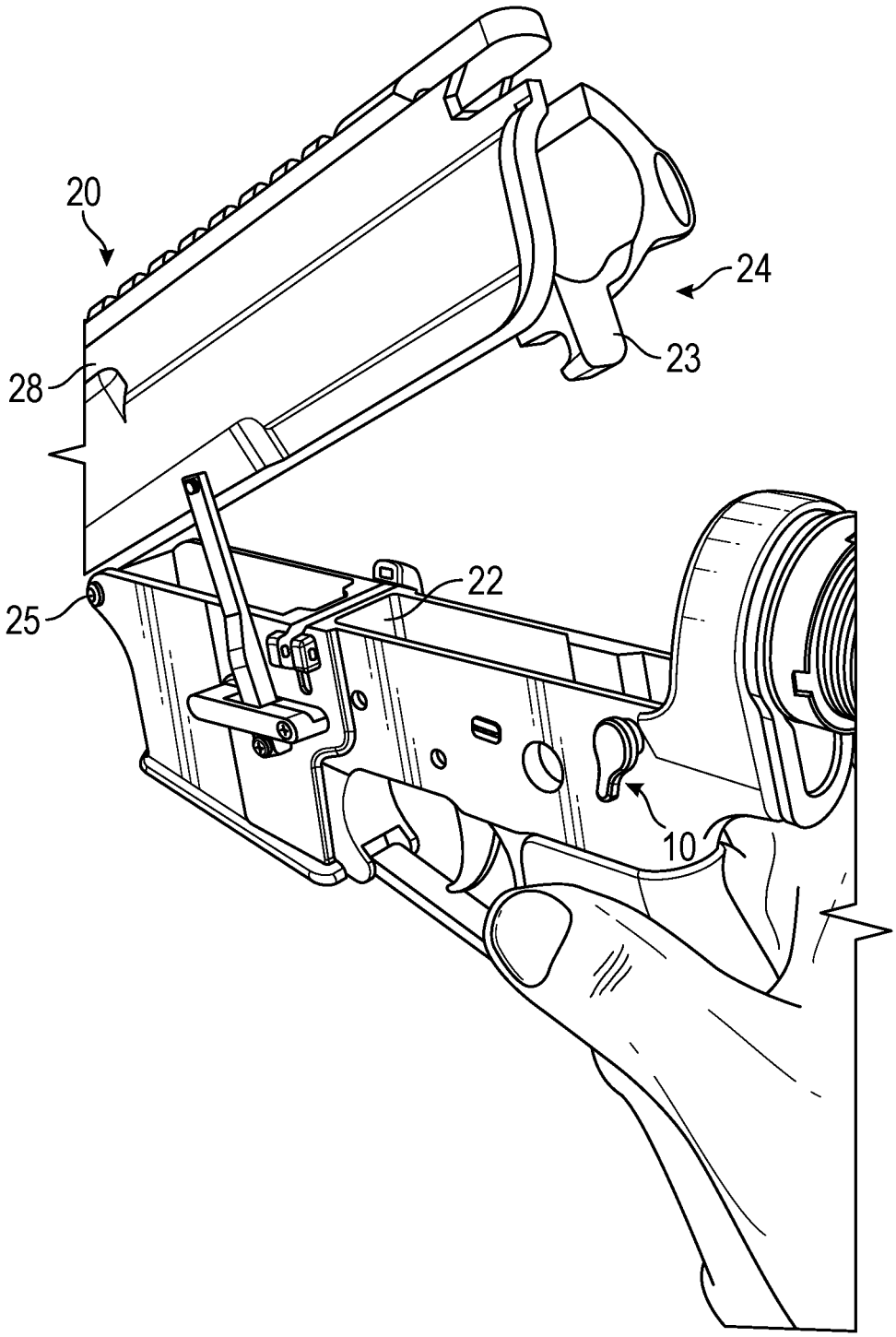
FIG. 1 is a perspective view of the invention as mounted to a firearm.
Figure 2:
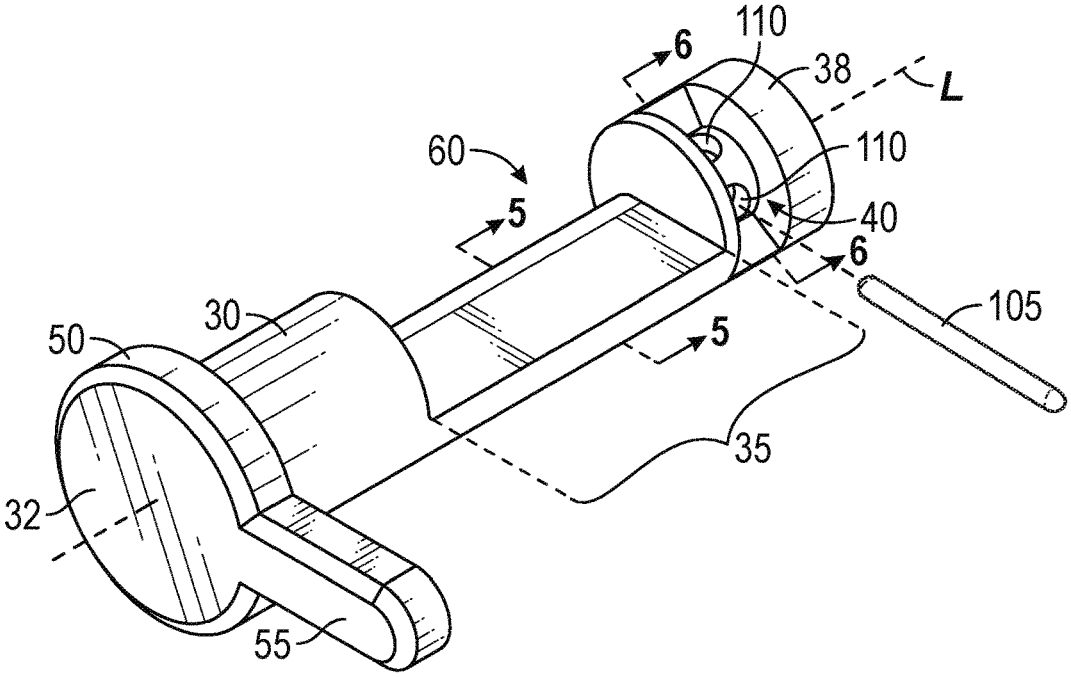
FIG. 2 is an enlarged perspective view of the invention with the firearm omitted for clarity.

FIGS. 1 and 2 illustrate a takedown pin 10 for a firearm 20 of the type having an upper receiver 28 and a lower receiver 22 fixed together with a front pivot pin 25 and a rear takedown pin mechanism 24 that includes a catch 23 or hook.

Figure 6:
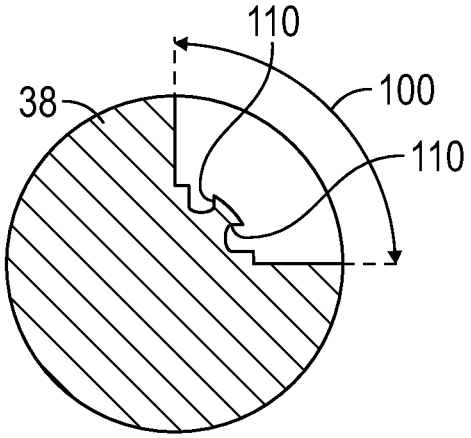
FIG. 6 is a cross-sectional view of the invention, taken along lines 6-6 of FIG. 2.

The takedown pin 10 comprises an elongated cylindrical body 30 having at a distal end 38 a pin capture mechanism 40. Preferably the pin capture mechanism 40 takes the form of a capture notch 40 (FIG. 2) that spans a radial range 100 of 0-degrees to about 90-degrees about a longitudinal axis L of the cylindrical body 30 (FIG. 6). A capture pin 105 (FIG. 2) of the firearm 20 may be selectively retained within the pin capture notch 40 to capture the takedown pin 10 within the takedown pin mechanism 24 and inhibit rotation thereof between 0-degrees and 90-degrees. The pin capture notch 40 may further include two detent apertures 110 (FIGS. 2 and 6), such that the capture pin 105 presses into each detent aperture 110 to provide tactile feedback that the takedown pin 10 is in either the engaged rotational position 70 or the disengaged rotational position 80.

Figure 5:
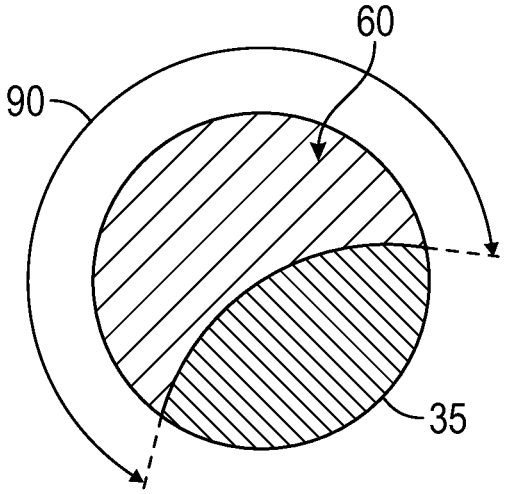
FIG. 5 is a cross-sectional view of the invention, taken along lines 5-5 of FIG. 2.

The takedown pin 10 has at a knob 50 at a proximal end 32 of the cylindrical body 30, and a clearance notch 60 at a central portion 35 of the cylindrical body 30. The cylindrical body 30 is adapted for rotational movement within the takedown pin mechanism 24 and traversed both the lower receiver 22 and the upper receiver's takedown pin mechanism 24. The knob 50 preferably includes a laterally-projecting lever 55 for indicating the orientation of the notch 60 from within the firearm 20. The notch 60 is preferably about half of the volume of the cylindrical body 30 at the central portion 35 thereof to allow clearance of the catch 23 of the takedown pin mechanism 24. Preferably the notch 60 spans a radial range 90 of 0-degrees to about 305-degrees about the longitudinal axis L of the cylindrical body 30 (FIG. 5).

In use, with the knob 50 in an engaged rotational position 70 (FIG. 4), the notch 60 of the cylindrical body 30 is misaligned with the catch 23 of the takedown pin mechanism 24 of the firearm 20, preventing the upper receiver 28 from being removed from the lower receiver 22. The notch 60 of the cylindrical body 30 becomes aligned with the catch 23 of the takedown pin mechanism 24 of the firearm 20 when the knob 50 is rotated to a disengaged rotational position 80, thereby allowing the catch 23 to pass the takedown pin 10 and thereby allowing the upper receiver 28 to be separated from the lower receiver 22, pivoting around the front pivot pin 25.

Figure 3:
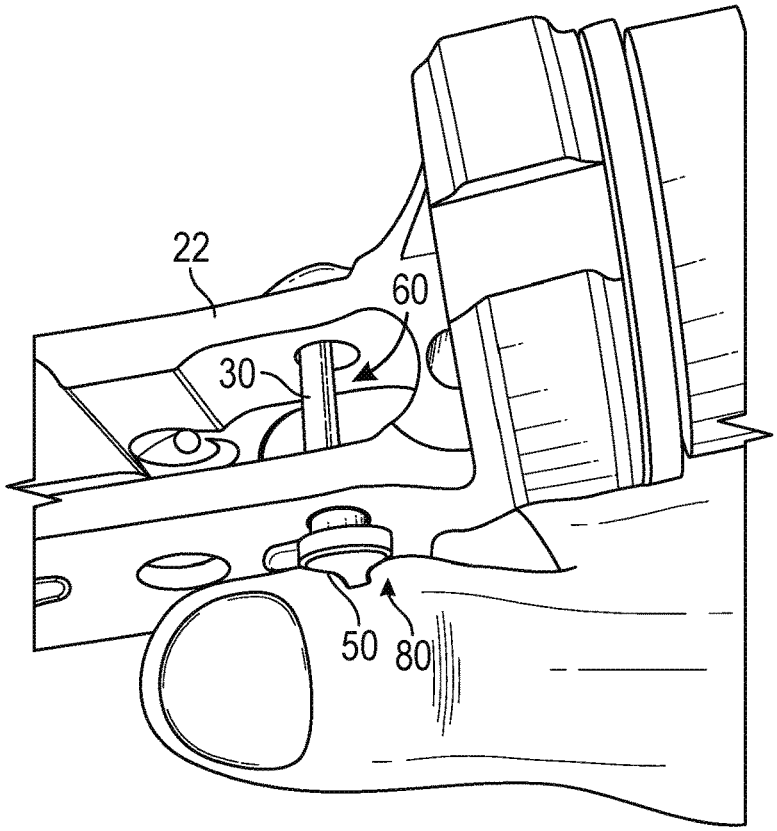
FIG. 3 is a top perspective view of the invention in a disengaged position.
Figure 4:
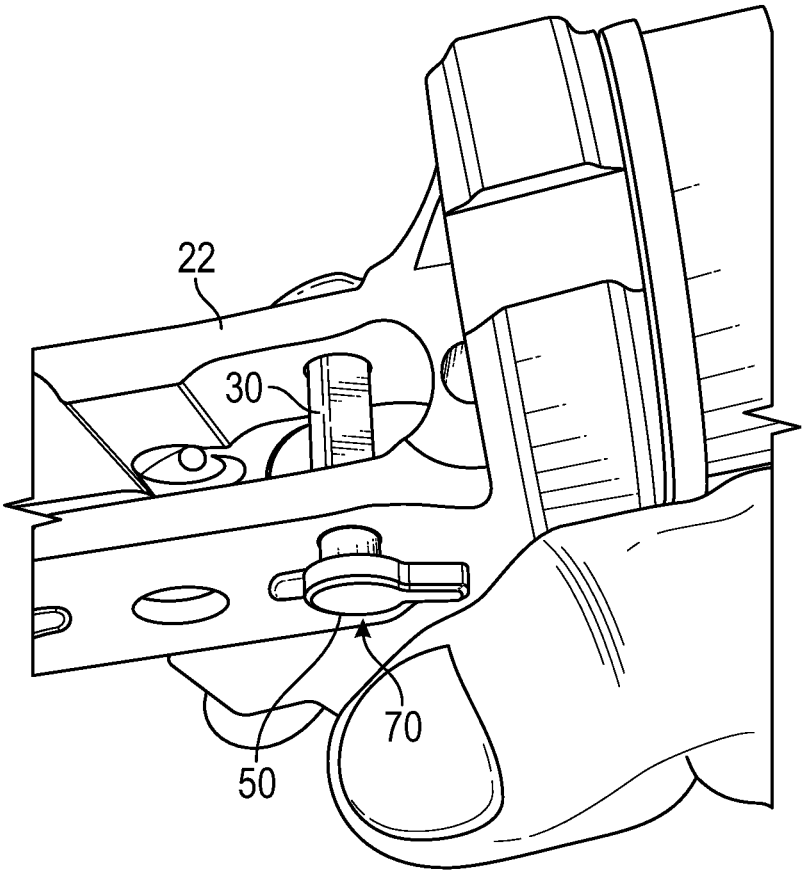
FIG. 4 is a top perspective view of the invention in an engaged position.

In firearms 20 that have a takedown pin aperture (not shown), the structure of the upper receiver 28 may first be modified to form the catch 23 or hook that will allow clearance of the takedown pin 10 past the catch 23 when the takedown pin 10 is in the disengaged rotational position 80. That is to say that such a takedown pin aperture, through which the takedown pin 10 would otherwise traverse, can be modified by cutting it substantially in half, such that the aperture now forms the catch 23 or hook. The catch 23 does not engage the takedown pin 10 when the takedown pin 10 is in the disengaged rotational position 80 (FIG. 3), but it does catch and engage the central portion 35 of the cylindrical body 30 adjacent the notch 60 when the takedown pin 10 is in the engaged rotational position 70 (FIG. 4).

While a particular form of the invention has been illustrated and described, it will be apparent that various modifications can be made without departing from the spirit and scope of the invention. For example, the knob 50 may take alternate shapes, such as circular, star with rounded points, etc. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A takedown pin for a firearm of the type having an upper receiver and a lower receiver fixed together with a front pivot pin and a rear takedown pin mechanism having a catch, the takedown pin comprising:

an elongated cylindrical body having at a distal end a pin capture mechanism, at a proximal end a knob, and in a central portion a clearance notch, the cylindrical body adapted for rotational movement within the takedown pin mechanism, the notch being substantially half of the volume of the cylindrical body at the central portion thereof;

whereby with the knob in an engaged rotational position, the notch of the cylindrical body is misaligned with the catch of the takedown pin mechanism of the firearm, preventing the upper receiver from being removed from the lower receiver, and whereby when the knob is rotated to a disengaged rotational position, the notch of the cylindrical body becomes aligned with the catch of the takedown pin mechanism of the firearm, allowing the upper receiver to be separated from the lower receiver.

2. The takedown pin of claim 1 wherein the knob includes a laterally-projecting lever for indicating an orientation of the notch within the firearm.

3. The takedown pin of claim 1 wherein the notch spans a radial range of 0-degrees to about 305-degrees about the longitudinal axis of the cylindrical body.

4. The takedown pin of claim 1 wherein the pin capture mechanism includes a capture notch that spans a radial range of 0-degrees to about 90-degrees about the longitudinal axis of the cylindrical body, whereby a capture pin of the firearm may be selectively retained within the pin capture notch to capture the takedown pin within the rear takedown pin mechanism and inhibit rotation thereof between 0-degrees and 90-degrees.

5. The takedown pin of claim 4 wherein the capture notch further includes two detent apertures, whereby the capture pin presses into each said detent aperture to provide tactile feedback that the takedown pin is in either the engaged rotational position or the disengaged rotational position.

6. A method of modifying a firearm of the type having an upper receiver and a lower receiver fixed together with a front pivot pin and a rear takedown pin and pin mechanism, so that the upper receiver may be removed from the lower receiver without having to remove the rear takedown pin, comprising the steps:

providing a replacement takedown pin having an elongated cylindrical body with a pin capture mechanism at a distal end thereof, a knob at a proximal end thereof, and a clearance notch in a central portion thereof, the notch being substantially half of the volume of the cylindrical body at the central portion thereof, the cylindrical body adapted for rotational movement within the takedown pin mechanism;

replacing the takedown pin with the replacement takedown pin;

if the takedown pin mechanism of the upper receiver includes an aperture through which the takedown pin traverses, modifying the aperture by cutting it substantially in half vertically so as to form a catch or hook;

assembling the firearm upper receiver to the lower receiver and placing the knob in an engaged rotational position, such that the notch of the cylindrical body is misaligned with the catch of the takedown pin mechanism of the firearm, preventing the upper receiver from being removed from the lower receiver; and rotating the knob to a disengaged rotational position, such that the notch of the cylindrical body becomes aligned with a catch of the takedown pin mechanism of the firearm, allowing the catch to pass the takedown pin and thereby allowing the upper receiver to be separated from the lower receiver.

* * * * *